US010240556B2

(12) United States Patent
Ni

(10) Patent No.: US 10,240,556 B2
(45) Date of Patent: Mar. 26, 2019

(54) PISTON WITH COOLING GALLERY COOLING INSERT AND METHOD OF CONSTRUCTION THEREOF

(71) Applicant: Federal-Mogul Corporation, Southfield, MI (US)

(72) Inventor: Frank Ni, Northville, MI (US)

(73) Assignee: Tenneco Inc., Lake Forest, IL (US)

( * ) Notice: Subject to any disclaimer, the term of this patent is extended or adjusted under 35 U.S.C. 154(b) by 400 days.

(21) Appl. No.: 15/011,784

(22) Filed: Feb. 1, 2016

(65) Prior Publication Data

US 2016/0222912 A1 Aug. 4, 2016

Related U.S. Application Data

(60) Provisional application No. 62/110,083, filed on Jan. 30, 2015.

(51) Int. Cl.
*F02F 3/22* (2006.01)
*F02F 3/00* (2006.01)
(Continued)

(52) U.S. Cl.
CPC ..... *F02F 3/22* (2013.01); *F02F 3/0015* (2013.01); *F02F 3/18* (2013.01); *F02F 3/26* (2013.01); *F02F 2003/0061* (2013.01)

(58) Field of Classification Search
CPC ..... F02F 3/22; F02F 3/18; F02F 3/26; F02F 3/0015; F02F 3/225; F02F 3/20; F02F 3/003; F16J 1/005
(Continued)

(56) References Cited

U.S. PATENT DOCUMENTS 1,547,687 A 7/1925 Rohwer
3,221,722 A 12/1965 Bachle
(Continued)

FOREIGN PATENT DOCUMENTS

DE 102011012758 A1 9/2012
DE 102011115826 A1 4/2013
(Continued)

OTHER PUBLICATIONS

International Search Report, dated Apr. 21, 2016 (PCT/US2016/015900).

*Primary Examiner* — Thomas E Lazo
*Assistant Examiner* — Richard C Drake
(74) *Attorney, Agent, or Firm* — Robert L. Stearns; Dickinson Wright, PLLC

(57) ABSTRACT

A piston for an internal combustion engine and method of construction thereof is provided. The piston has a top part and a bottom part. The top part has an upper combustion surface including a top surface with a combustion bowl recessed therein. An annular combustion bowl rim extends between the top surface and a side wall of the combustion bowl. The bottom part has a bottom wall and a pair of pin bosses depending therefrom. The top part is fixed to the bottom part with an annular cooling gallery defined therebetween. The side wall of the combustion bowl has a radially outwardly facing side bounding a portion of the cooling gallery, wherein an annular recessed channel is formed therein adjacent the combustion bowl rim. A cooling ring is disposed in the annular channel. The cooling ring channels coolant adjacent the combustion bowl rim to facilitate cooling the combustion bowl rim.

25 Claims, 6 Drawing Sheets

(51) Int. Cl.
*F02F 3/26* (2006.01)
*F02F 3/18* (2006.01)

(58) Field of Classification Search
USPC ..... 92/231, 260
See application file for complete search history.

(56) References Cited

U.S. PATENT DOCUMENTS 4,175,502 A * 11/1979 Moebus ..... F02F 3/0023 123/193.6
4,368,697 A * 1/1983 Moebus ..... F02F 3/0076 123/193.6
4,776,075 A 10/1988 Kawabata et al.
4,907,545 A 3/1990 Mills
5,771,776 A 6/1998 Itoh
5,947,065 A * 9/1999 Bing ..... B22D 19/0027 123/193.6
5,979,298 A 11/1999 Whitacre
6,513,477 B1 * 2/2003 Gaiser ..... F02F 3/003 123/193.6
6,532,913 B1 3/2003 Opris
6,539,910 B1 * 4/2003 Gaiser ..... F02F 3/003 123/193.6
7,281,466 B1 * 10/2007 Wilksch ..... B22C 9/105 92/186
7,337,539 B2 * 3/2008 Mayr-Kohn ..... B23P 15/10 123/41.35
7,380,536 B2 6/2008 Issler
7,549,368 B2 6/2009 Heidrich et al.
7,685,710 B2 * 3/2010 Scharp ..... B21K 1/185 29/888.04
8,347,842 B2 * 1/2013 Sadowski ..... F02F 3/22 123/193.6
8,813,712 B2 * 8/2014 Bing ..... B23K 26/28 123/193.6
9,163,579 B2 * 10/2015 Aharonov ..... F02F 3/10
9,228,480 B2 * 1/2016 Wirkkala, II ..... F01P 3/10
9,429,099 B2 * 8/2016 Wilder ..... F02F 3/22
9,765,728 B2 * 9/2017 Bischofberger ..... F02F 3/22
2011/0174245 A1 * 7/2011 Kollotzek ..... F02F 3/22 123/41.39
2013/0104838 A1 * 5/2013 Spangenberg ..... F02F 3/16 123/193.6
2014/0352647 A1 * 12/2014 Linke ..... F02F 3/22 123/193.6
2015/0184613 A1 * 7/2015 Linke ..... F02F 3/22 123/41.35
2018/0209375 A1 * 7/2018 Azevedo ..... F02F 3/22

FOREIGN PATENT DOCUMENTS

DE 102012014200 A1 5/2014
JP S6153545 U 4/1986
JP S63127756 U 8/1988
JP 05187313 7/1993

* cited by examiner

PISTON WITH COOLING GALLERY COOLING INSERT AND METHOD OF CONSTRUCTION THEREOF

CROSS-REFERENCE TO RELATED APPLICATION

This application claims the benefit of U.S. Provisional Application Ser. No. 62/110,083, filed Jan. 30, 2015, which is incorporated herein by reference in its entirety.

BACKGROUND OF THE INVENTION

1. Field of the Invention

The present invention is related generally to internal combustion engines, and more particularly to pistons used in internal combustion engines.

2. Related Art

Manufacturers of internal combustion engines are constantly looking for ways to improve engine performance and fuel economy. To improve fuel economy, engine manufacturers may, for example, reduce oil pump size, but that in turn can reduce the volume of cooling oil supplied to the pistons, which can result in overheating of the pistons, or at least portions of the pistons, namely, the combustion bowl rim, which is known to be amongst the hottest regions of a piston during use. Both performance and fuel economy can be improved by increasing compression loads and temperatures within the cylinder bores, but the pistons must be able to accommodate such loads and temperatures without failing, particularly in a potentially oil starved environment.

Typically, the top wall of the piston, and in particular the edge or rim of the combustion bowl experiences the highest operating temperature than any other region of the piston. This is because combustion initiates in the adjacent combustion bowl and the rim presents a somewhat sharp edge that typically projects radially inwardly and is prone to rapid heating as compared to surrounding areas due to the relatively high surface-to-volume ratio that it presents to the heat of combustion.

SUMMARY OF THE INVENTION

A piston for an internal combustion engine is provided. The piston has a piston body including a top part and a bottom part. The top part has an upper combustion surface configured for direct exposure to combustion gasses within a cylinder bore. The upper combustion surface has a top surface with a combustion bowl recessed therein. The combustion bowl has a floor and an annular side wall extending upwardly toward the top surface. An annular combustion bowl rim extends between the top surface and the side wall. The bottom part has a bottom wall and a pair of pin bosses depending from the bottom wall, wherein the pin bosses have axially aligned pin bores and the bottom wall has an oil inlet. The top part is fixed to the bottom part with an annular cooling gallery formed therebetween. The bottom wall forms a portion of the cooling gallery with the oil inlet extending into the cooling gallery. The side wall has a radially outwardly facing side bounding a portion of the cooling gallery, wherein an annular recessed channel is formed in therein adjacent the combustion bowl rim. A cooling ring is disposed in the annular channel. The cooling ring is configured to suspend and channel coolant therein adjacent the combustion bowl rim to facilitate cooling the combustion bowl rim.

In accordance with another aspect of the invention, the cooling ring is snapped into a spring biased fit into the annular channel.

In accordance with another aspect of the invention, the cooling ring has opposite free ends spring biased in spaced relation from one another.

In accordance with another aspect of the invention, the cooling ring can have a circumferentially discontinuous wall as viewed in lateral cross-section to further facilitate cooling the combustion bowl rim by allowing oil to make direct contact with the radially outwardly facing side wall.

In accordance with another aspect of the invention, the wall can include arcuate free edges spaced from one another by an annular gap, wherein the annular gap faces the annular channel to facilitate cooling the combustion bowl rim, and the arcuate free edges contact the annular channel to facilitate containing oil in the cooling ring, thereby further enhancing the cooling effect of the oil in the region of the combustion bowl rim.

In accordance with another aspect of the invention, the opposite free ends can remain open to allow oil to flow outwardly from the cooling ring to facilitate circulating a continuous, fresh supply of oil through the cooling ring, thereby further enhancing the cooling effect of the oil in the region of the combustion bowl rim.

In accordance with another aspect of the invention, the wall of the cooling ring can have an oil inlet port aligned axially with the oil inlet in the bottom wall to facilitate introducing a fresh supply of oil into the cooling ring thereby further enhancing the cooling effect of the oil in the region of the combustion bowl rim.

In accordance with another aspect of the invention, the cooling ring can have a circumferentially continuous wall as viewed in lateral cross-section.

In accordance with another aspect of the invention, the cooling ring can have a cooling medium sealed therein.

In accordance with another aspect of the invention, a method of constructing a piston for an internal combustion engine is provided. The method includes forming a top part having an upper combustion surface configured for direct exposure to combustion gasses within a cylinder bore; forming the upper combustion surface having a top surface and combustion bowl recessed therein; forming the combustion bowl having a floor and an annular side wall extending upwardly toward the top surface and forming an annular combustion bowl rim extending between the top surface and the side wall; forming the top part having an annular upper outer collar and an annular upper inner collar spaced radially from one another to define an upper portion of a cooling gallery; forming an annular channel in the upper portion of the cooling gallery adjacent the combustion bowl rim; forming a bottom part having a bottom wall and a pair of pin bosses depending from the bottom wall; forming the pin bosses having axially aligned pin bores and forming the bottom wall having an oil inlet; disposing a cooling ring in the annular channel; and fixing the top part to the bottom part to form the annular cooling gallery therebetween.

In accordance with another aspect of the invention, the method further includes snapping the cooling ring into a spring biased fit into the annular channel, thereby improving the ease of manufacturability.

In accordance with another aspect of the invention, the method further includes spreading opposite free ends of the cooling ring away from one another to provide the spring biased fit in the annular channel.

In accordance with another aspect of the invention, the method further includes forming the cooling ring having a circumferentially discontinuous wall as viewed in lateral cross-section.

In accordance with another aspect of the invention, the method further includes forming the wall having arcuate free edges spaced from one another by an annular gap and orienting the annular gap to face the annular channel with the arcuate free edges abutting the annular channel.

In accordance with another aspect of the invention, the method further includes forming the opposite free ends being open to allow oil to flow outwardly from the cooling ring.

In accordance with another aspect of the invention, the method further includes forming an oil inlet port in the wall and aligning the oil inlet port axially with the oil inlet in the bottom wall.

In accordance with another aspect of the invention, the method further includes forming the cooling ring having a circumferentially continuous wall as viewed in lateral cross-section.

In accordance with another aspect of the invention, the method further includes sealing a cooling medium in the cooling ring.

BRIEF DESCRIPTION OF THE DRAWINGS

These and other aspects, features and advantages of the invention will become more readily appreciated when considered in connection with the following detailed description and accompanying drawings, in which.

DETAILED DESCRIPTION OF PRESENTLY PREFERRED EMBODIMENTS

Figure 1:
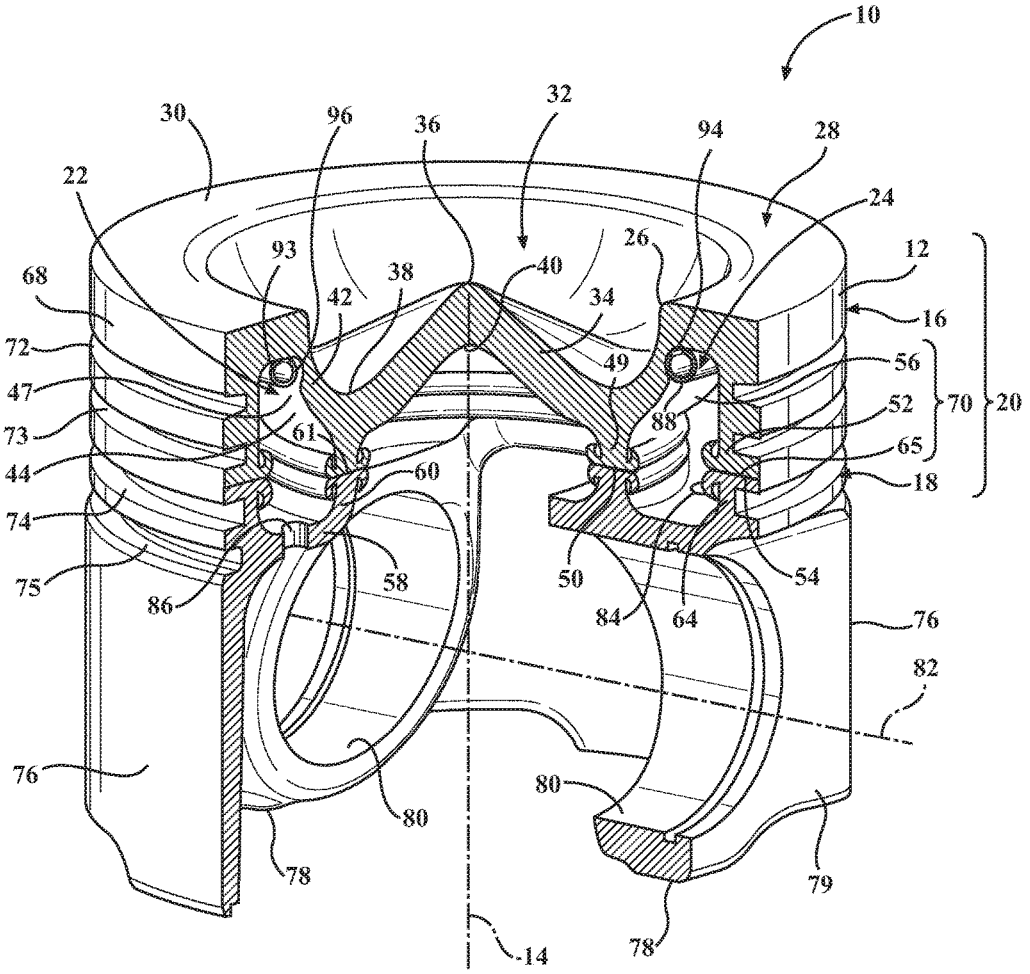
FIG. 1 is a quarter cross-sectional view of a piston constructed in accordance with one aspect of the invention.

Referring in more detail to the drawing, FIG. 1 illustrates a partial cross-sectional view of a piston 10 constructed in accordance with one embodiment of the invention for reciprocating movement in a cylinder bore or chamber (not shown) of an internal combustion (IC) engine, such as a modern, compact, high performance vehicle engine, for example. The piston 10 includes a body 12 extending along a longitudinal central axis 14 along which the piston reciprocates in use. The body 12 has an upper crown, also referred to as upper or top part 16, and a lower crown, also referred to as lower or bottom part 18, which are joined to one another within a head region 20. The top and bottom parts 16, 18 are initially fabricated as separate pieces of material, such as in casting, forging or machining processes, and are then subsequently joined to one another, whereupon an internal, annular outer oil cooling gallery 22 is formed therebetween through which oil flows to facilitate cooling the piston head region 20. The top and bottom parts 16, 18 may be joined to one another by various types of welding processes, such as, but not limited to, induction welding, friction welding, braze joint, charge carrier rays, laser, or resistance welding. Furthermore, although the illustrated embodiment utilizes weld joints to join the top part 16 to the bottom part 18, it is contemplated herein that the top part 16 and bottom part 18 may be joined together by other fastening techniques and mechanisms, such as gluing or mechanical fasteners, by way of example and without limitation. It is to be recognized that the reference to "top", "bottom", "upper" and "lower" herein are relative to the piston 10 being oriented along the central axis 14 along which the piston 10 reciprocates in use. This is for convenience and is not to be limiting since it is possible that the piston 10 may be installed and operate at an angle or other than generally vertical. In accordance with one aspect of the invention, a cooling gallery cooling insert ring, referred to hereafter simply as cooling ring 24, is disposed within the cooling gallery 22 to facilitate cooling the hottest portion of the piston head region 20, and known to be a combustion bowl rim 26 of the piston 10.

The top part 16 of the piston 10 has an upper combustion surface 28, which includes a substantially planar uppermost, annular top surface 30 that surrounds a combustion bowl 32, which is recessed below the annular top surface 30. The combustion bowl 32 includes a floor 34 that may have a uniform or constant thickness extending between the upper combustion surface and a bottom surface, also known as an undercrown surface. Although the floor 34 of the illustrated embodiment has a uniform thickness, it will be appreciated that the floor 34 of other embodiments contemplated herein may have a varying thickness between the upper combustion surface and the bottom surface. The upper combustion surface of the floor 34 is contoured, sometimes referred to as a "Mexican hat," and provides a center peak 36 disposed coaxially along the central axis 14 of the piston 10. It should be understood that the center peak 36 may be radially offset relative to the central axis 14 in other embodiments contemplated herein. The floor 34 of the combustion bowl 32 provides an annular valley 38 which surrounds the peak 36 to form the lowest portion of the combustion bowl 32. The bottom or undercrown surface of the floor 34 follows or substantially follows the contour of the upper combustion surface of the combustion bowl 32 to provide an elevated lower peak 40 directly underlying the peak 36. The lower peak 40 is configured to accommodate the small end of a connecting rod (not shown).

Figure 4:
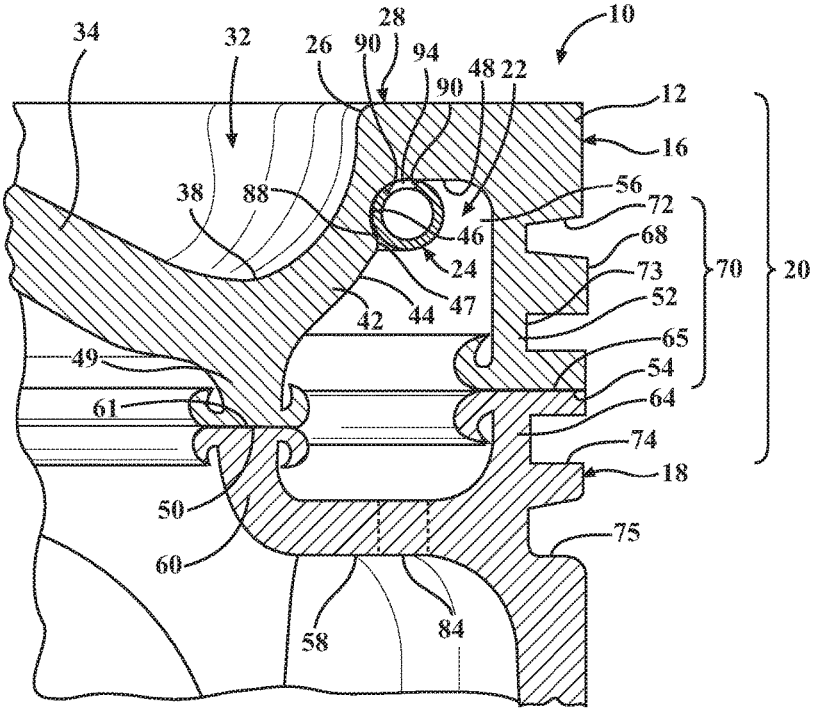
FIG. 4 is an enlarged partial cross-sectional view of the piston of FIG. 1 taken generally through an annular cooling gallery of the piston illustrating a piston cooling ring engaging a channel in accordance with one aspect of the invention.

The combustion bowl 32 of the top part 18 includes an annular side wall 42 surrounding and extending upwardly from the combustion bowl floor 34. The side wall 42 is located adjacent the valley 38 and extends upwardly from the valley 38 to the top surface 30, wherein the annular combustion bowl rim 26 transitions the side wall 42 with the top surface 30. The combustion bowl rim 26 can be formed to extend radially inwardly from the side wall 42 to provide an undercut, annular reentrant cavity in the side wall 42, if desired. As best shown in FIG. 4, an opposite, radially outwardly facing side of the side wall 42 of the combustion bowl 32 forms a portion of an inner surface 44 of the cooling gallery 22. The inner surface 44 has an annular recess or channel 46 that surrounds the combustion bowl 32 adjacent the combustion bowl rim 26, and is shown to be immediately adjacent an uppermost inner surface 48 of the cooling gallery 22. The annular channel 46 is configured for snapping, spring biased receipt of the cooling ring 24, and has an annular lower lip 47 to promote snapping receipt of the cooling ring 24.

The top part 16 of the piston 10 further includes at least one upper inner annular joining rib or collar 49 that depends from the bottom surface of the floor 34 of the combustion bowl 32 adjacent the valley 38 to an upper inner joining surface 50. The top part 24 also includes an upper outer annular joining rib or collar 52 that depends from the top surface 30 to an upper outer joining surface 54, wherein the upper outer annular collar 52 and the upper inner annular collar 49 are radially spaced from one another by an annular upper portion 56 of the cooling gallery 22.

The bottom part 18 of the piston 10 includes an annular floor, referred to hereafter as bottom wall 58, which forms a floor of the cooling gallery 22. When joined with the top part 16 of the piston 10, the bottom wall 58 merges into the floor 34 of the combustion bowl 32 radially inwardly of the side wall 42 via a lower inner annular joining rib or collar 60 that extends upwardly from the bottom wall 58 to a lower inner joining surface 61. The bottom part 26 also includes a lower outer annular joining rib or collar 64 that extends upwardly from the bottom wall 58 to a lower outer joining surface 65, wherein the lower outer annular collar 64 and the lower inner annular collar 60 are radially spaced from one another by an annular lower portion 66 of the cooling gallery 22.

The lower outer annular collar 62 of the bottom part 18 and the upper outer annular collar 52 of the top part 16 form an annular outer wall 68 that extends downwardly from the top surface 30. An annular ring belt region 70 is formed in the outer wall 68, wherein a plurality of annular ring grooves 72, 73, 74 are formed within the ring belt region 70 for receiving piston rings (not shown). In the exemplary embodiment, the ring grooves 72, 73, 74 include an uppermost ring groove 72 adjacent to the top surface 30 for receiving a compression ring (not shown); an intermediate ring groove 73 disposed below the uppermost ring groove 72 for receiving an intermediate wiper ring (not shown); and a lowermost ring groove 74 disposed below the intermediate ring groove 73 for receiving a lowermost oil ring (not shown). An oil drainage groove 75 is formed below the lowermost ring groove 74 for reducing weight and to collect oil and divert it to the bottom part 18 of the piston 10 and back to the oil sump. While the exemplary embodiment of the invention includes three ring grooves 72, 73, 74, other embodiments of the invention may include any number of ring grooves.

Figure 2:
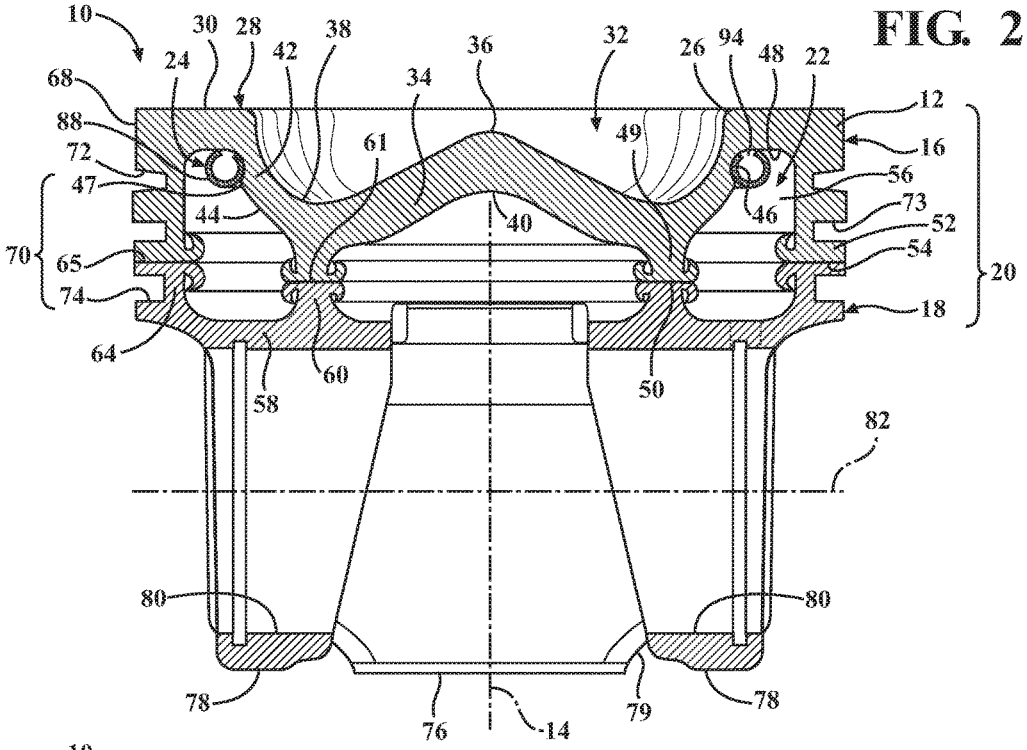
FIG. 2 is a cross-sectional view of the piston of FIG. 1 taken generally along a pin bore axis of the piston.
Figure 3:
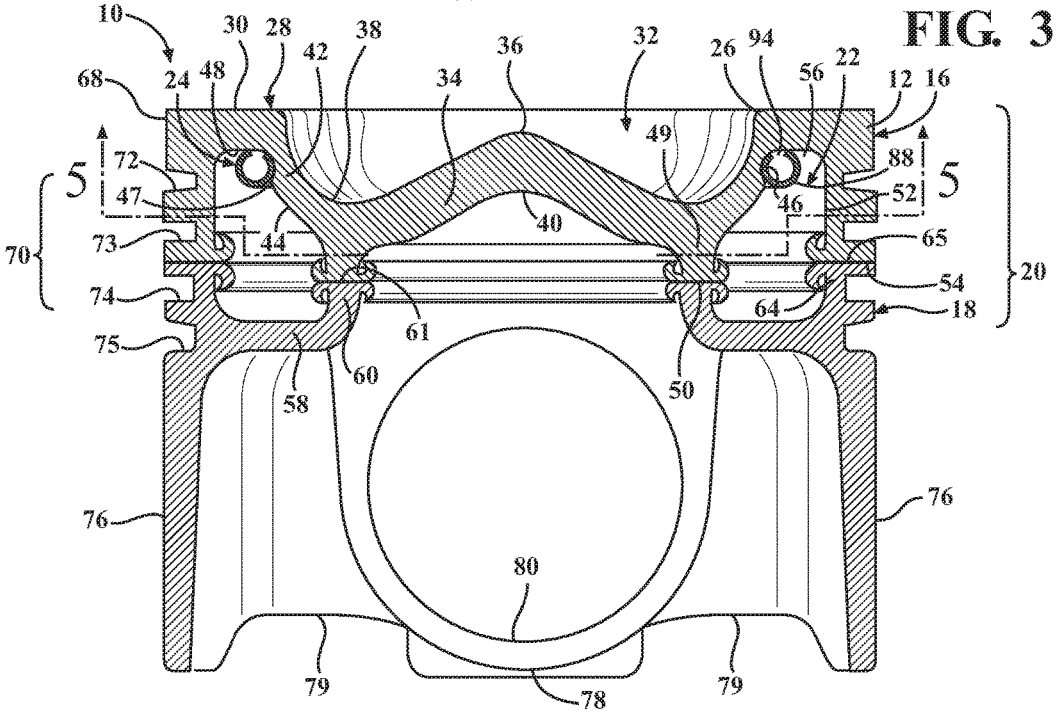
FIG. 3 is a cross-sectional view of the piston of FIG. 1 taken generally transversely to the pin bore axis of the piston.

The bottom part 18 of the piston 10 further includes a pair of skirt panels 76 depending from the bottom wall 58. The skirt panels 76 are joined along their longitudinally extending sides directly to a pair of pin bosses 78 via strut portions 79, wherein the pin bosses 78 provide a pair of laterally spaced pin bores 80. As best shown in FIG. 2, the pin bores 80 are spaced from one another coaxially along a pin bore axis 82 extending transverse to the central axis 14. The skirt panels 76 are generally arranged diametrically opposite one another across opposite sides of the pin bosses 78. The skirt panels 76 include convex outer surfaces that are contoured for mating cooperation with a surface of a cylinder bore to maintain the piston 10 in a desired orientation as it reciprocates through the cylinder bore.

The bottom wall 58 of the bottom part 18 is spaced axially in axial alignment from the top surface 30, and the outer wall 68 of the ring belt region 70 is spaced radially outwardly from the side wall 42 of the combustion bowl 32 to form the annular oil cooling gallery 22 within the head region 20 of the piston 10. The oil cooling gallery 22 of the exemplary embodiment is an annular toroid-shaped chamber; however, it should be understood that the oil cooling gallery 22 may be shaped as desired depending on the relative contours of the combustion bowl 32 and bottom wall 58. The bottom wall 58 includes at least one through opening forming an oil inlet 84 that is open to the bottom of the piston 10. The oil inlet 84 is in direct fluid communication with the oil cooling gallery 22 for introducing a continuous flow or stream of oil from a crank sump supply source (e.g. oil jet of the engine). The bottom wall 58 may also include at least through opening forming an oil outlet 86 to facilitate the continual flow of oil throughout the cooling gallery 22 during reciprocation of the piston 10. It should be recognized that the fluid dynamics of the oil flow is provided such that oil from the oil sump enters the oil cooling gallery via the oil inlet 84 and exits the oil cooling gallery via the oil outlet 86.

The cooling ring 24 is fixed in the upper region of the oil cooling gallery 22 adjacent the top surface 30 and adjacent the combustion bowl rim 26 to facilitate cooling the rim 26 and top surface 30 of the head region 20. The cooling ring 24 extends annularly about the side wall 42 of the combustion bowl 32 within the annular channel 46, wherein the radially outwardly extending lower lip 47 of the channel 46 maintains the cooling ring 24 in the channel 46 via interference fit caused by the radially inwardly applied spring bias of the cooling rim 24. In the exemplary embodiment, the cooling ring 24 has a circumferentially extending discontinuous wall 88, as viewed in lateral cross-section, such that the wall 88 is generally C, U or V shaped in lateral cross-section, by way of example and without limitation. As such, as best shown in FIG. 4, the wall 88 has arcuate free edges 90 extending annularly between opposite free ends 92, 93 (FIG. 5) of the cooling ring 24. The free edges 92, 93 are spaced from one another by an annular gap 94 that is oriented to face the annular channel 46 and allows oil to flow freely therethrough into fluid contact with the side wall 42 and/or uppermost surface 48 of the cooling gallery 22. Thus, with the free edges 92, 93 abutting the side wall inner surface 44 of the annular channel 46 and/or the uppermost surface 48 of the cooling gallery 22, the oil flowing through the cooling ring 24 is able to flow through the gap 94 into direct contact with the inner surfaces 44, 48, thereby conducting heat directly from the side wall 42 uppermost wall forming the top surface 30, thereby reducing the operating temperature of the immediately adjacent combustion bowl rim 26 and top surface 30. To facilitate the ingress of oil into the cooling ring 24, the wall 88 has an inlet port 95 (best shown in FIGS. 4A and 5) that is configured in axial alignment with the oil inlet 84 in the bottom wall 58, and thus, oil being sprayed through the oil inlet 84 is able to be at least partially sprayed directly into the cooling insert ring 24 via the inlet port 95.

The cooling gallery ring 24 is preformed to take on a substantially closed loop configuration, and is sized annularly to be clipped or snapped into the recessed annular channel 46, wherein the snapping receipt of the cooling ring 24 causes the free ends 92, 93 to spread slightly away from one another under a spring bias to create a radially inwardly clamping spring force that automatically retains the cooling ring 24 in the channel 46 and prevents relative movement between the cooling ring 24 and the piston body 12 during reciprocation of the piston 10 during use. It should be recognized that the spring bias force is established as a result of the cooling ring 24 being bent or otherwise formed into a predefined closed or substantially closed loop having a predefined inner diameter that is smaller than an outer diameter of the lower lip 47, and preferably at least slightly smaller than the outer diameter of a valley of the annular channel 46. In addition to the free ends 92, 93 acting to facilitate a spring bias, the free ends, being open, form outlet ports 96 that allow the oil to flow freely out of the cooling ring 24. The inlet port 95 and the outlet ports 96 are configured generally diametrically opposite one another, though slight angular deviations are contemplated herein, which facilitate the oil flowing substantially about the entirety of the combustion bowl rim 26 to provide optimal cooling thereto.

As a result of the piston 10 of the exemplary embodiment being fabricated using two parts 16, 18, it can be appreciated that the cooling ring 24 may be clipped or snapped to the top part 16 prior to joining the top part 16 to the bottom part 18. The gallery cooling ring 24 of the exemplary embodiment advantageously attaches to the piston 10 without having to be being cast in place. Therefore, manufacturing of a piston 10 in accordance with one aspect of the invention, if cast, is simplified. It is to be understood that although the gallery cooling ring 24 is clipped or snapped in the channel 46 of the exemplary embodiment, other embodiments may include gallery cooling rings 24 which are attached in various other ways including, but not limited to welding using various types of welding processes, including cold spray welding, tack welding, resistance welding, and gluing using various types of metal joining adhesives, or by mechanical fasteners.

In view of the above, it should be recognized that the oil flowing within the cooling ring 24 can be distributed more quickly, directly and efficiently to the areas of the piston 10 in need of cooling, namely the combustion bowl rim 26 and upper combustion surface 28 of the piston 10. Without the cooling ring 24, distribution of oil into the upper region of the cooling gallery 22 nearest the combustion bowl rim 26 and upper combustion surface 28 is likely to be inefficient, and any oil that does reach these areas does not remain in cooling contact with the combustion bowl rim 26 and upper combustion surface 28. As such, the gallery cooling ring 24, in contrast, allows oil to be retained in the upper region of the cooling gallery 22 in the areas in most need of cooling (i.e. the combustion bowl rim 26 and upper combustion surface 28) for an extended period of time, thereby continuously removing heat from these regions.

The gallery cooling ring 24 of the exemplary embodiment is preferably constructed of a high heat conductive material such as, but not limited to copper or aluminum to provide optimal conductive heat transfer. It is known that the combustion bowl rim 26 can be as much as approximately 150-200 degrees C. higher than other regions of the top of the piston 10. However, it is usually desirable to ensure that the temperature of the combustion bowl rim 26 is below approximately 520 degrees C. during engine operation. In providing lower temperatures at the combustion bowl rim 26, engine manufacturers may be able, for example, to reduce oil pump size due to the increased heat transfer from the upper combustion surface 28 and the combustion bowl rim 26 as a result of the presence of the cooling ring 24. Reducing oil pump size can then lead to increased fuel efficiency for the internal combustion engine in which the piston 10 operates.

Figure 4A:
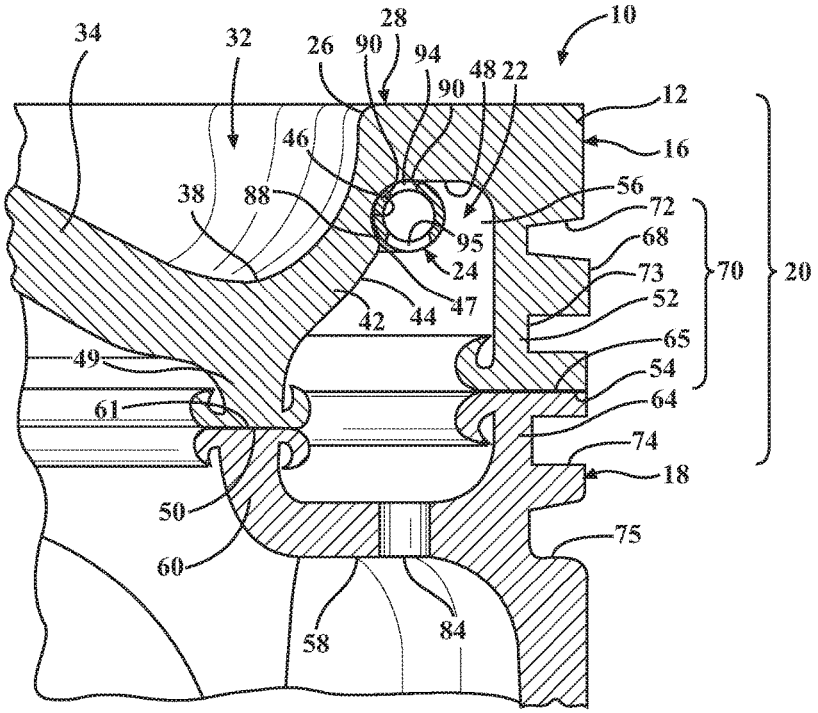
FIG. 4A is a view similar to FIG. 4 taken generally through inlet openings of the annular cooling gallery and the piston cooling ring.
Figure 4B:
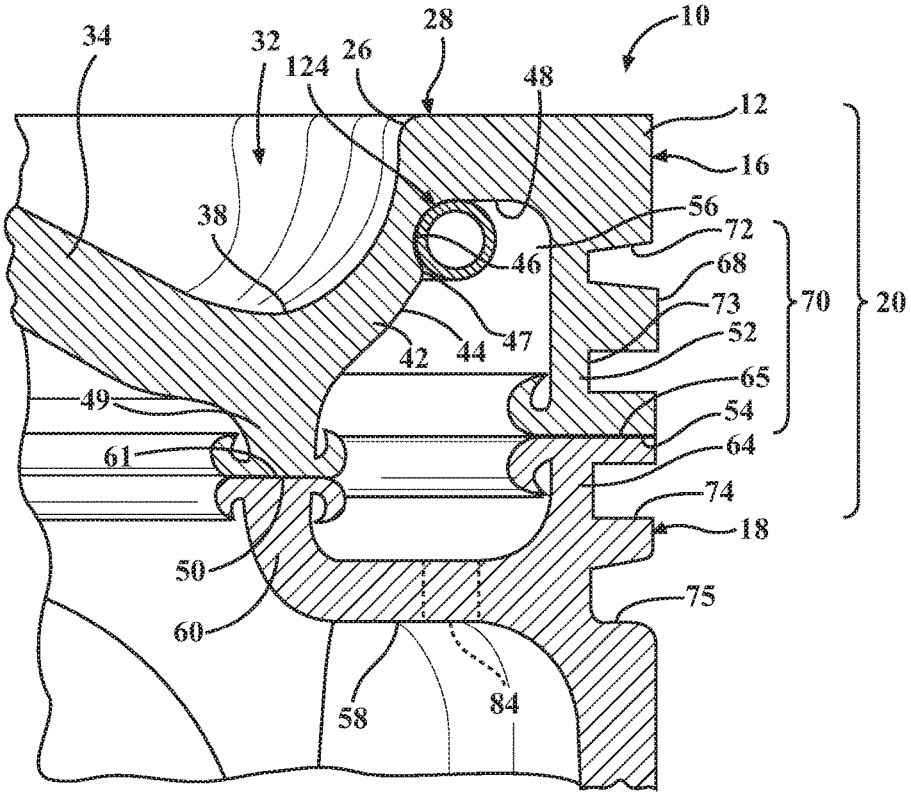
FIG. 4B is a view similar to FIG. 4 illustrating a piston and cooling ring constructed in accordance with an alternate aspect of the invention.
Figure 5:
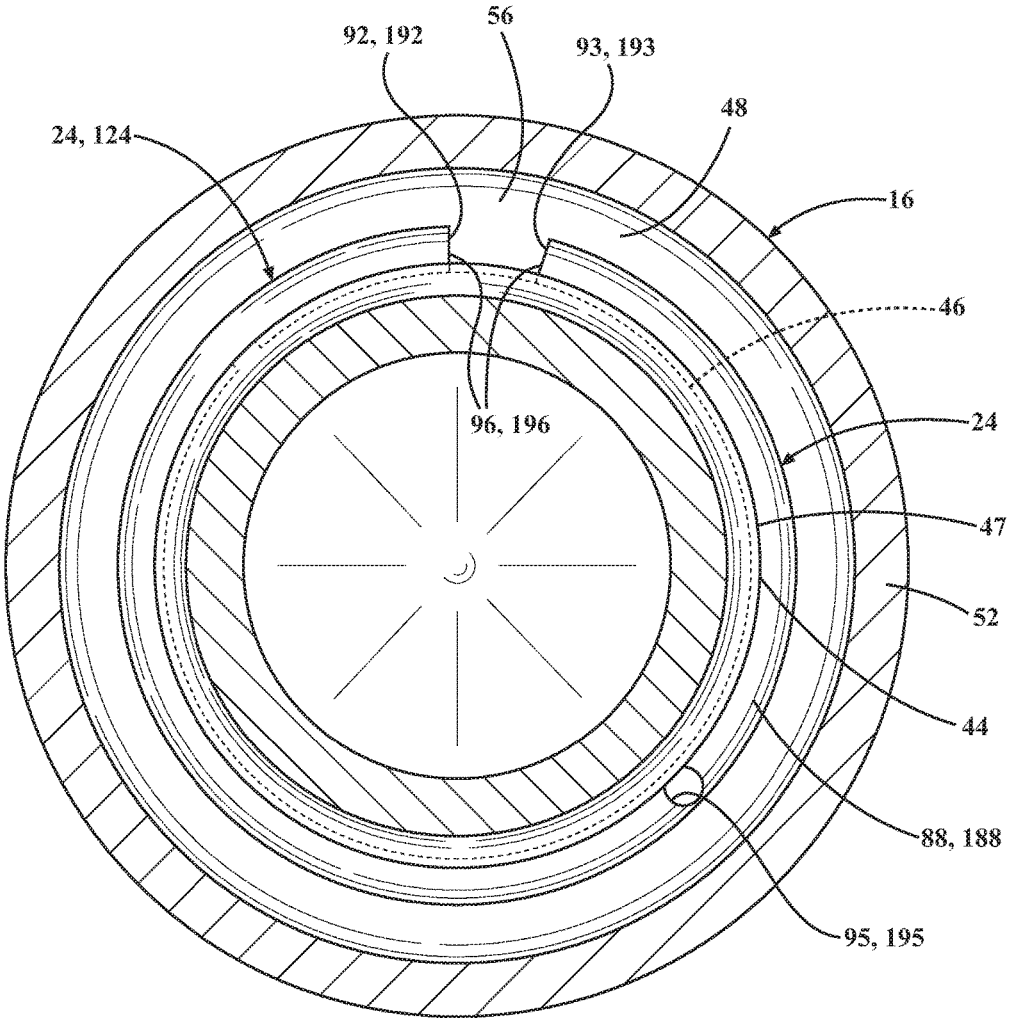
FIG. 5 is a bottom cross-sectional view taken generally along the line 5-5 of FIG. 3.

Although the exemplary embodiment includes the gallery cooling ring 24 having a circumferentially discontinuous shape, discussed above as being generally C, U or V shaped, by way of example and without limitation, it is to be recognized that the gallery cooling ring 124 can have alternate shapes as viewed in lateral cross-section, such as be a tubular shape with a round or circular cross-section, as shown in FIG. 4A. It should be further understood that the insert may take other forms than being round, such as, but not limited to a tube having a square or rectangular shaped cross-section. The cooling ring 124 has an identical appearance as the cooling ring 24 when viewed from the bottom, as shown in FIG. 5, and thus, no reproduction of a drawing is believed necessary. The cooling ring 124 has an inlet port 195, as shown and as discussed above, and opposite free ends 192, 193 similarly configured as discussed above, thereby providing outlet ports 196 and the ability to be slightly separated from one another to provide the spring clipping attachment within the annular channel 46. As such, other than having a circumferentially continuous wall 188, the cooling ring 124 is the same as discussed above, and thus, no further description is believed necessary.

Figure 5A:
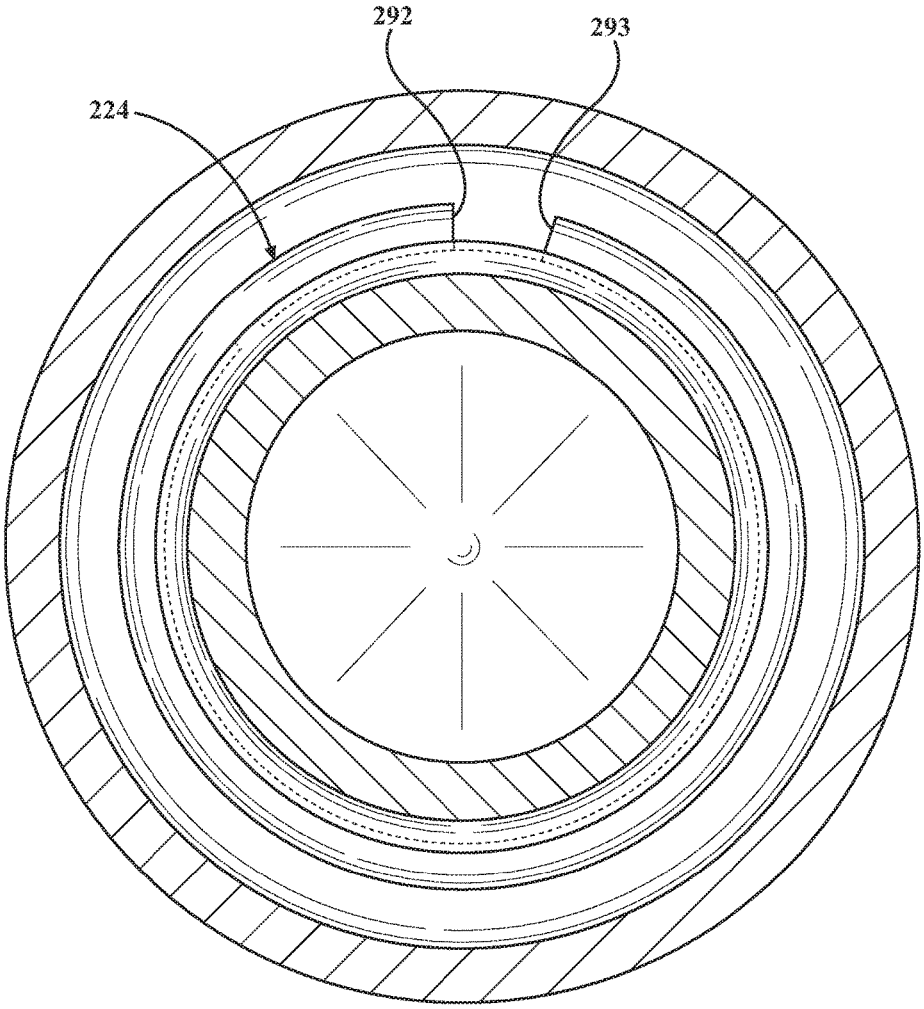
FIG. 5A is a view similar to FIG. 5 illustrating a piston and cooling ring constructed in accordance with an alternate aspect of the invention.

In accordance with yet another aspect of the invention, as shown in FIG. 5A, a cooling ring 224 constructed in accordance with another aspect of the invention may also be sealed to contain an alternative cooling medium, such as an inert gas (e.g. argon) and/or liquid coolant. The cooling medium may even be a solid material. Alternative cooling mediums may easily be sealed in the cooling ring 224 prior to its installation in the piston 10 and may be intended to remain active in the cooling ring 224 for the life of the piston 10 or to be consumed or broken down over time. Of course, being sealed, the cooling ring 224 does not have any inlet or outlet ports as discussed above, but it can still have free ends 292, 293 that are sealed off, such as upon disposing the desired cooling medium within the cooling ring 224, via any suitable sealing mechanism, including sealants, end plugs crimping, or any combination thereof, so long as the cooling medium remains hermetically sealed in the cooling ring 224. Otherwise, the cooling ring is assembled within the annular channel 46 as discussed above.

Obviously, many modifications and variations of the present invention are possible in light of the above teachings. It is, therefore, to be understood that within the scope of the appended claims, the invention may be practiced otherwise than as specifically described and shown.

What is claimed is:

1. A piston for an internal combustion engine, comprising:

a piston body including a top part and a bottom part, said top part having an upper combustion surface configured for direct exposure to combustion gasses within a cylinder bore, said upper combustion surface having a top surface and combustion bowl recessed therein, said combustion bowl having a floor and an annular side wall extending upwardly toward said top surface, with an annular combustion bowl rim extending between said top surface and said side wall;

said bottom part having a bottom wall and a pair of pin bosses depending from said bottom wall, said pin bosses having axially aligned pin bores and said bottom wall having an oil inlet;

said top part being fixed to said bottom part with an annular cooling gallery being formed therebetween, said bottom wall forming a portion of said cooling gallery with said oil inlet extending into said cooling gallery, said side wall having a radially outwardly facing side bounding a portion of said cooling gallery, said radially outwardly facing side having an annular recessed channel formed therein adjacent said combustion bowl rim; and a cooling ring being spring biased and disposed in said annular channel, said cooling ring being configured to channel coolant therein adjacent said combustion bowl rim.

2. The piston of claim 1 wherein said cooling ring is snapped into said annular channel.

3. The piston of claim 2 wherein said cooling ring has opposite free ends spring biased in spaced relation from one another.

4. The piston of claim 3 wherein said cooling ring has a circumferentially discontinuous wall as viewed in lateral cross-section.

5. The piston of claim 4 wherein said wall in generally c-shaped as viewed in lateral cross-section.

6. The piston of claim 4 wherein said wall has arcuate free edges spaced from one another by an annular gap, wherein said annular gap faces said annular channel and said arcuate free edges abut said annular channel.

7. The piston of claim 6 wherein said opposite free ends are open to allow oil to flow outwardly from said cooling ring.

8. The piston of claim 4 wherein said wall has an oil inlet port aligned axially with said oil inlet in said bottom wall.

9. The piston of claim 3 wherein said cooling ring has a circumferentially continuous wall as viewed in lateral cross-section.

10. The piston of claim 9 wherein said wall has an oil inlet port aligned axially with said oil inlet in said bottom wall.

11. The piston of claim 10 wherein said opposite free ends are open to allow oil to flow outwardly from said cooling ring.

12. The piston of claim 9 wherein said cooling ring has a cooling medium sealed therein.

13. The piston of claim 2 wherein said top part has an annular upper outer collar and an annular upper inner collar spaced radially from one another and said bottom part has an annular outer lower collar and an annular inner lower collar spaced radially from one another, said annular upper outer collar being fixed to said annular outer lower collar and said annular upper inner collar being fixed to said annular lower inner collar.

14. A method of constructing a piston for an internal combustion engine, comprising:

forming a top part having an upper combustion surface configured for direct exposure to combustion gasses within a cylinder bore, forming the upper combustion surface having a top surface and combustion bowl recessed therein, forming the combustion bowl having a floor and an annular side wall extending upwardly toward the top surface and forming an annular combustion bowl rim extending between the top surface and the side wall, forming the top part having an annular upper outer collar and an annular upper inner collar spaced radially from one another to define an upper portion of a cooling gallery, forming an annular channel in the upper portion of the cooling gallery adjacent the combustion bowl rim;

forming a bottom part having a bottom wall and a pair of pin bosses depending from the bottom wall, forming the pin bosses having axially aligned pin bores and forming the bottom wall having an oil inlet;

disposing a cooling ring in the annular channel with the cooling ring being spring biased; and fixing the top part to the bottom part to form the annular cooling gallery therebetween.

15. The method of claim 14 further including snapping the cooling ring into the annular channel.

16. The piston of claim 15 further including spreading opposite free ends of the cooling ring away from one another to provide the spring biased fit.

17. The method of claim 16 further including forming the cooling ring having a circumferentially discontinuous wall as viewed in lateral cross-section.

18. The method of claim 17 further including forming the wall having arcuate free edges spaced from one another by an annular gap and orienting the annular gap to face the annular channel with the arcuate free edges abutting the annular channel.

19. The method of claim 18 further including forming the opposite free ends being open to allow oil to flow outwardly from the cooling ring.

20. The method of claim 17 further including forming an oil inlet port in the wall and aligning the oil inlet port axially with the oil inlet in the bottom wall.

21. The method of claim 16 further including forming the cooling ring having a circumferentially continuous wall as viewed in lateral cross-section.

22. The method of claim 21 further including forming an oil inlet port in the wall and aligning the oil inlet port axially with the oil inlet in the bottom wall.

23. The method of claim 22 further including forming the opposite free ends being open to allow oil to flow outwardly from the cooling ring.

24. The method of claim 21 further including sealing a cooling medium in the cooling ring.

25. The method of claim 14 further including forming the bottom part having an annular outer lower collar and an annular inner lower collar spaced radially from one another and welding the annular upper outer collar to the annular outer lower collar and welding the annular upper inner collar to the annular lower inner collar.

* * * * *